United States Patent [19]

Goncharov

[11] 4,322,289

[45] Mar. 30, 1982

[54] ROLLER FOR CLEANING MESHES OF ROTARY SCREENS

[76] Inventor: Evgeny S. Goncharov, ulitsa Lomonosova 30/1, kv. 46, Kiev, U.S.S.R.

[21] Appl. No.: 75,109

[22] Filed: Sep. 13, 1979

[30] Foreign Application Priority Data

Nov. 28, 1978 [SU] U.S.S.R. ..... 2688201[I]

[51] Int. Cl.[3] ..... B07B 1/50

[52] U.S. Cl. ..... 209/384; 15/3; 29/130; 209/296

[58] Field of Search ..... 15/179, 181, 21 D, 97 R, 15/230, 230.11, 230.14, 230.16, 256.52, 3; 209/389, 384, 390; 210/396, 397, 413–415; 29/130, 132

[56] References Cited

U.S. PATENT DOCUMENTS

| | | | |
|---|---|---|---|
| 410,377 | 9/1889 | Rich | 209/384 X |
| 1,213,239 | 1/1917 | Noll | 209/384 |
| 1,749,393 | 3/1930 | Pflimlin | 29/132 |
| 2,145,418 | 1/1939 | Herchenrider | 29/130 |
| 2,221,173 | 11/1940 | Gutsell | 29/130 |
| 2,581,934 | 1/1952 | Kubaugh | 29/130 X |
| 2,915,182 | 12/1959 | Burnet et al. | 209/384 X |
| 3,514,829 | 6/1970 | Blatt | 29/130 |
| 4,121,521 | 10/1978 | Gill | 29/130 |

FOREIGN PATENT DOCUMENTS

| | | | |
|---|---|---|---|
| 1954732 | 10/1970 | Fed. Rep. of Germany | 29/132 |
| 307819 | 9/1979 | U.S.S.R. . | |
| 485784 | 9/1979 | U.S.S.R. . | |

OTHER PUBLICATIONS

Rock Products Publication; p. 60; Published Oct., 1937.

*Primary Examiner*—Edward L. Roberts
*Attorney, Agent, or Firm*—Fleit & Jacobson

[57] ABSTRACT

A roller or brush for cleaning meshes of rotary screens, comprising a shaft having one or several cleaning members each comprising a body of revolution consisting of two concentrically arranged portions. The outer part in contact with the screen surface is of a stiffness several times greater than the stiffness of the inner portion adjacent to the shaft so that dynamic load at the contact of the brush and screen is several times lower, the efficiency of cleaning of meshes of the screen is improved and the service life of the screen is substantially prolonged.

5 Claims, 5 Drawing Figures

ROLLER FOR CLEANING MESHES OF ROTARY SCREENS

Figure 1:
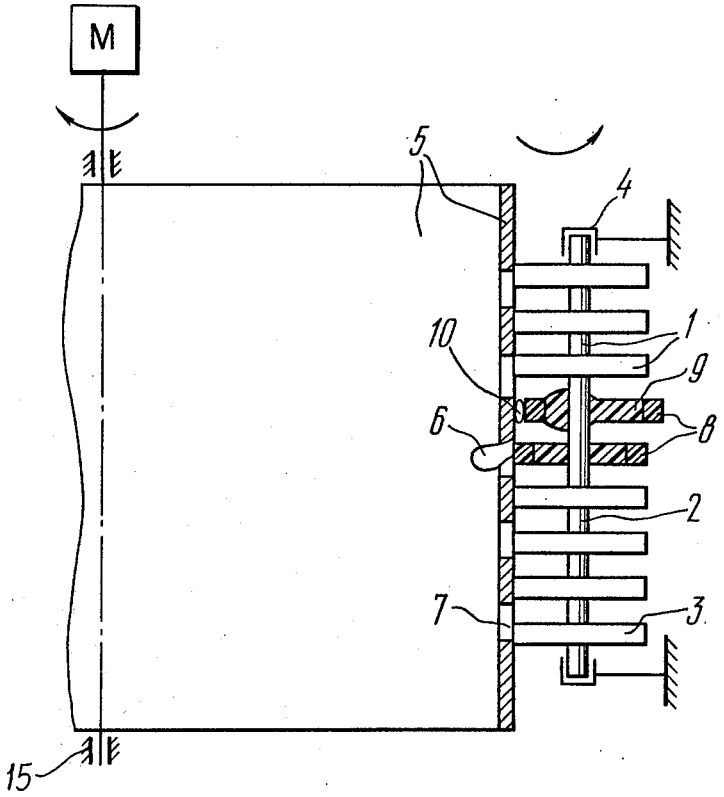

The invention relates to machines for cleaning and/or classifying granular materials, in particular, to rollers or brushes for cleaning meshes of rotary screens. It may be successfully used in the agriculture for handling grain, in chemical and mining industry for classifying various granular materials, and the like.

Known in the art are brushes for cleaning rotary screens, having a shaft and a cleaning member secured thereto which are assembled of bristles having their free ends defining a surface of a body of revolution (cf. USSR Inventor's Certificate No. 485,784, Cl. B 07 B 1/26). These bristle brushes cannot, however, ensure the cleaning of rotary screens from particles strongly seized in their meshes under the action of centrifugal force which may be several times greater than the gravity of particles.

Also known in the art are brushes for cleaning rotary screens, having a shaft supporting cleaning members each comprising a body of revolution with a smooth working surface (cf. USSR Inventor's Certificate No. 307,819, Cl. B 07 B). During rotation of the screen the brushes are urged against it by a pre-set initial force, roll over its surface and force seized particles of the material being separated from its meshes.

To ensure an efficient cleaning of meshes, the material of the cleaning members should have a required stiffness. This stiffness is such that after the brush hits against a bump on the screen surface (e.g. in case a particle of the material being separated gets between the surfaces of the cleaning member and screen), the brush is separated from the screen thus considerably impairing the quality of mesh cleaning. This is especially pronounced with rapidly rotating screens performing simultaneous oscillations. At the moment of hitting against such bump or particle an impact occurs resulting in a stress concentration in the screen and cleaning members of the brush. In addition, upon the next hitting of the brush against the screen after the separation occurred, an impact occurs again. As such impacts occur one after another at a relatively high rate, fatigue failures take place in the screen, and the service life of the cleaning members is reduced.

The provision of cleaning members of the brush of a flexible material permits to the brush to follow the screen surface, hence, diminishes the effect of the above factors. The working surface of the cleaning members, however, yields under the action of particles strongly seized in the screen meshes, and their cleaning is not ensured.

The main object of the invention is to improve the efficiency of cleaning of rotary screen meshes.

Another object of the invention is to improve the through put capacity of screens being cleaned.

An important object of the invention is to prolong the service life of screens being cleaned.

An additional object of the invention is to prolong the service life of the cleaning members of the brush or roller.

These and other objects are accomplished by that in a brush or roller for cleaning rotary screen meshes, comprising a shaft having one or several cleaning members each comprising a body of revolution, according to the invention, the body of revolution consists of two concentrically arranged portions of which the outer portion which is in contact with the screen surface has a stiffness several times greater than that of the inner portion adjacent to the shaft.

This construction of the brush or roller enables an improvement of the efficiency of cleaning of screen meshes, prolongs the service life of its cleaning members and the service life of the screens.

The outer and inner parts of the cleaning members are preferably manufactured of different materials.

This ensures a reduction of cost of the cleaning members, e.g. owing to the use of a cheaper material for the inner portion.

In certain applications the inner and outer portions of the cleaning members are preferably made of the same material, but the thickness of the inner portion may be several times smaller than that of the outer portion.

In certain applications the inner and outer portions are preferably made of the same material, but the density of the inner portion should be several times lower than the density of the outer portion.

This facilitates the manufacturing process in making the cleaning members.

Figure 3A:
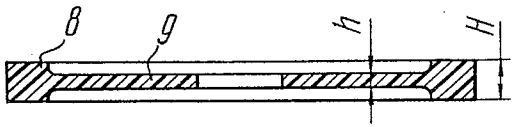
Figure 3B:
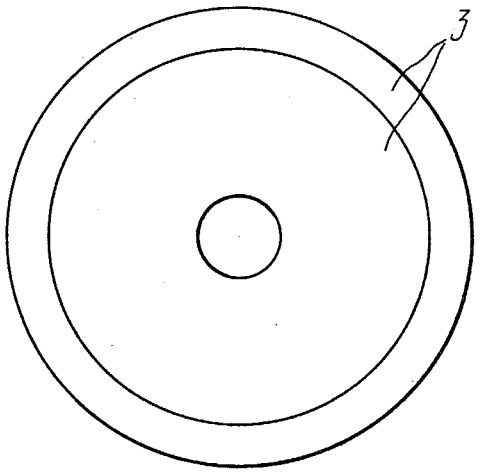
Figure 2A:
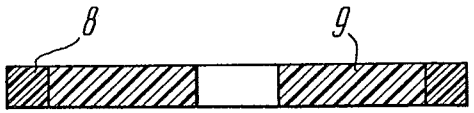
Figure 2B:
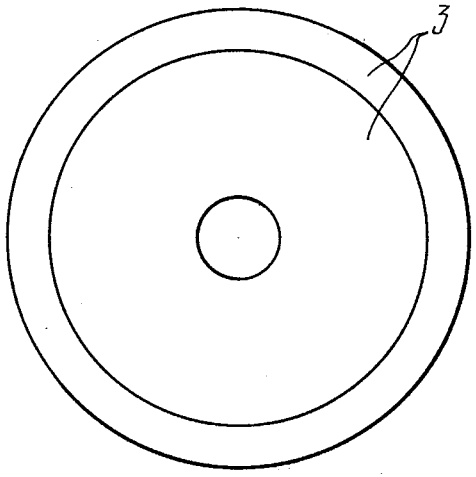

The invention will now be described with reference to specific embodiments thereof illustrated in the accompanying drawings, in which:

FIG. 1 schematically shows, in a sectional view, a relative arrangement of a brush or roller according to the invention and a rotary cylindrical screen;

FIGS. 2*a* and 2*b* schematically show, in a sectional view, two elevations of a cleaning member made of different materials according to the invention;

FIGS. 3*a* and 3*b* schematically show, in a sectional view, two elevations of a cleaning member made of a single material according to the invention.

A brush or roller 1 according to the invention for cleaning meshes of rotary screens (FIG. 1) comprises a shaft 2 to which are secured cleaning members 3. The shaft 2 is journalled in bearings 4 against the surface of a rotary screen 5. The outer surface of the cleaning members 3 should be urged against the outer surface of the screen 5 by an initial force which is sufficient to force particles 6 of the material being separated out from meshes 7 of the screen 5. The cleaning member 3 consists of two concentrically arranged portions 8 and 9 (FIG. 2*a*), the outer portion 8 in contact with the surface of the screen 5 (FIG. 1) being of a stiffness several times greater than the stiffness of the inner portion 9 adjacent to the shaft 2.

The amount of stiffness of the outer portion 8 of the cleaning member 3 is chosen preferably depending on the strength of seizure of the particles 6 of the separated material in the meshes 7 of the screen 5 and it should be high enough to ensure reliable cleaning of the meshes 7.

Higher stiffness of the outer portion 8 (FIG. 2*a*) relative to the stiffness of the inner portion 9 of the cleaning member 3 may be obtained by making the portions 8 and 9 of different materials. The outer portion 8 is made of a material which is several times more rigid than the material of the inner portion 9. This facility reduced the cost of the cleaning member, e.g. owing to the use of a a cheaper material for making the inner portion 9. Thus, the outer portion 8 (FIG. 2*a*) may be made of a hard wear resistant polyurethane, and the inner part 9, of porous rubber.

The outer portion 8 and the inner portion 9 may also be made of the same material, but to impart different stiffness thereto, according to the invention, the thickness "h" of the inner portion 9 (FIG. 3*a*) should be several times smaller than the thickness "H" of the outer portion 8. The same result may be achieved by imparting to the inner portion 9 (FIG. 3*a*) a density several times lower than the density of the outer portion 8. Thus, the outer portion 8 (FIG. 3*a*) may be made of a hard rubber, and the inner portion 9 may be made of a porous rubber. This construction of the cleaning members 3 (FIG. 1) simplifies the manufacturing process.

In the working position the screen 5 (FIG. 1) is supported in bearings 15 and rotated about its axis in the direction of the arrow by a suitable mechanism, such as motor M. The brush or roller 1 in contact with the screen 5 also rotates about its axis owing to the frictional engagement of the cleaning members 3 with the surface of the screen 5. When the cleaning member 3 hits against the particle 6 seized in the mesh 7, the more stiff outer portion 8 of the cleaning member forces the particle 6 from the mesh 7 without any appreciable deformation of the inner less stiff portion 9. The cleaning member 3 hits against some stiff bump 10 on the surface of the screen 5 at regular intervals, when such bump gets between the cleaning member 3 and the surface of the screen 5. The force of contact of the cleaning member 3 with the screen 5 increases, and its outer portion 8 is displaced away from the surface of the screen 5 at a distance corresponding to the thickness of the bump 10 owing to elastic deformation of the inner portion 9. Other cleaning members 3 of the brush or roller 1 remain engaged with the surface of the screen 5 so that the efficiency of cleaning of its meshes is improved.

Other cleaning members 3 of the brush or roller 1 also perform similar movement, but the simultaneous separation of all cleaning members 3 from the surface of the screen 5 is very unlikely.

The mass of the outer portion 8 of the cleaning member 3 is many times smaller than the mass of the brush or roller 1. Therefore regular impacts of the cleaning members 3 against the surface of the screen 5 spaced in time affect its strength in a much less intense manner compared to the use of conventional mesh cleaners of rotary screens. At the same time, the cleaning members 3 of the brush or roller 1 are also less prone to wear.

The provision of the cleaning member 3 (FIG. 1) of the brush or roller 1 for cleaning meshes 7 of rotary screens 5 according to the invention enables an improvement of the efficiency of cleaning of meshes of such screens and prolongs the service life of the cleaning members.

The employment of the brush or roller 1 for cleaning the meshes 7 of the rotary screen according to the invention in conventional machines, e.g. for separating various granular materials, makes it possible to reduce dynamic loads at the contact of the brush or roller 1 with the screen 5 by several times, prolongs the service life of the screen and considerably improves the efficiency of separation of granular materials.

What is claimed is:

1. An apparatus for cleaning meshes of rotary screens, the rotary screens being mounted for rotation about a first axis, said apparatus comprising:

a shaft;

means for mounting said shaft for rotation about a second axis parallel to and spaced from said first axis;

a plurality of cleaning members mounted on said shaft, each cleaning member comprising a body of revolution having an outer portion and an inner portion arranged concentrically in one another, said inner portion being secured to said shaft and the space between said second axis and said first axis being such that said outer portion engages the surface of said screen, said outer portion having a stiffness several times greater than the stiffness of said inner portion so that during rotation of the screen said outer portion contacts and dislodges particles entrapped in the meshes of the surface of the rotary screen, said inner portion being resiliently deformable to allow movement of said outer portion away from the screen when said outer portion contacts a stiff bump on the surface of the screen.

2. An apparatus for cleaning meshes of rotary screens according to claim 1, wherein said outer portion and said inner portion forming said cleaning member are made of different materials.

3. An apparatus for cleaning meshes of rotary screens according to claim 1, wherein said outer portion and said inner portion forming said cleaning member are made of the same material, and said inner portion has a thickness several times smaller than the thickness of said outer portion.

4. An apparatus for cleaning meshes of rotary screens according to claim 1, wherein said outer portion and said inner portion forming said cleaning member are made of the same material, and said inner portion has a density several times lower than the density of said outer portion.

5. An apparatus according to claim 1 wherein the cleaning members are mounted on the shaft at a substantial distance from one another to allow deformation of said inner portion of each cleaning member independently of the inner portions of others of said cleaning members, each of the cleaning members having a length substantially smaller than the diameter thereof.

* * * * *